US006640870B2

(12) United States Patent
Osinga

(10) Patent No.: US 6,640,870 B2
(45) Date of Patent: Nov. 4, 2003

(54) EQUALIZING CONNECTOR FOR WINDOW COVERING PULL CORDS

(75) Inventor: Anne J. Osinga, Rockanje (NL)

(73) Assignee: Hunter Douglas Industries BV (NL)

( * ) Notice: Subject to any disclaimer, the term of this patent is extended or adjusted under 35 U.S.C. 154(b) by 34 days.

(21) Appl. No.: 09/887,466

(22) Filed: Jun. 21, 2001

(65) Prior Publication Data

US 2002/0195211 A1 Dec. 26, 2002

(51) Int. Cl.[7] ..... E06B 9/30

(52) U.S. Cl. ..... 160/178.1 R; 24/129 R; 24/128

(58) Field of Search ..... 160/178.1 R, 173 R, 160/168.1 R, 176.1 R, 172 R; 16/428, 442; 24/115 F, 115 R, 129 D, 129 R, 128, 545

(56) References Cited

U.S. PATENT DOCUMENTS

| | | | | |
|---|---|---|---|---|
| 4,821,789 A | * | 4/1989 | Van Rens | 160/176.1 R |
| 4,909,298 A | | 3/1990 | Langhart et al. | |
| 5,473,797 A | | 12/1995 | Wu | |
| 5,504,977 A | | 4/1996 | Weppner et al. | |
| 5,560,414 A | | 10/1996 | Judkins et al. | |
| 5,562,140 A | | 10/1996 | Biba | |
| 5,592,983 A | | 1/1997 | Sartini et al. | |
| 5,630,458 A | * | 5/1997 | Holden | 160/178.1 R |
| 5,671,508 A | * | 9/1997 | Murai | 24/115 K |
| 5,715,884 A | | 2/1998 | Cotten | |
| 5,906,233 A | | 5/1999 | May | |
| 5,908,063 A | * | 6/1999 | Gobidas | 160/178.1 R |
| 5,918,656 A | * | 7/1999 | Daniels et al. | 160/168.1 R |
| 6,044,527 A | * | 4/2000 | Ishida et al. | 24/129 R |

FOREIGN PATENT DOCUMENTS

| | | |
|---|---|---|
| WO | WO 99/37875 | 7/1999 |

* cited by examiner

*Primary Examiner*—David M. Purol
(74) *Attorney, Agent, or Firm*—Dorsey & Whitney LLP

(57) ABSTRACT

A connector for joining the ends of a plurality of lift cords from a window covering assembly together. Each lift cord is individually secured to the assembled connector via its own securing arrangement. A pull cord extends downwardly from the connector for use in raising or lowering the window covering.

30 Claims, 12 Drawing Sheets

EQUALIZING CONNECTOR FOR WINDOW COVERING PULL CORDS

BACKGROUND OF THE INVENTION

1. Field of the Invention

The present invention relates to a connector for window covering lift cords. More particularly, this invention relates to an equalizing connector that joins the ends of the lift cords and attaches a pull cord thereto.

2. Description of the Relevant Art

In a typical vertically retractable window covering assembly, a plurality of lift cords are attached at spaced locations to a bottom or foot rail of the covering with each lift cord extending upwardly into a headrail. In the headrail, the lift cords are routed longitudinally of the headrail through a cord lock mechanism that is typically located proximate one end of the headrail. The cords then extend downwardly, terminating in a tassel. To raise the window covering, a user pulls on either the downwardly extending portions of the lift cords or the tassel. If a user pulls one lift cord more than another, the window covering may rise unevenly, causing the foot rail to tilt.

To help ensure that the lift cords are pulled evenly when raising a window shade, cord equalizing connectors have been utilized. Ostensibly, a cord equalizing connector secures the downwardly extending portions of the lift cords together at a location at or above a location where a user will typically pull the lift cords to raise the window covering. Accordingly, the window covering is raised evenly when the lift cords are pulled via the connector. However, depending on how the lift cords are secured within the connector, it is conceivable one or more of the lift cords may eventually slip relative to the other lift cords, causing the window covering to rise unevenly. Slippage is especially likely if a user pulls only one of the plurality of lift cords that may exit the bottom of the connector, wherein the load placed on the single lift cord may be sufficient to overcome the mechanism used to secure the lift cord relative to the other lift cords within the connector.

Lift cord connectors have also been utilized wherein the plurality of lift cords terminate at and are secured within the connecter and a single pull cord is attached to and hangs downwardly from the connector. Advantageously, the load induced by pulling the single pull cord is transferred equally to all the lift cords thereby, minimizing the likelihood of lift cord slippage, and ensuring that the window covering rises evenly. Depending on the design of the lift cord connector, the connector may be (i) difficult to assemble, (ii) aesthetically undesirable, or (iii) prone to failure.

SUMMARY OF THE INVENTION

A connector for joining a plurality of lift cords of a window covering assembly is described. In preferred embodiments of the connector, a single pull cord depends from the bottom of the connector for operating the window covering assembly, although in other embodiments. A pull cord need not depend from the connector wherein the connector performs a function similar to that of a tassel.

In a first preferred embodiment, the connector comprises two sections. Two inner surfaces of the sections are joined together to restrain the lift cords. In one variation thereof, one or both of the inner surfaces include channels which when enclosed, confine the lift cords. The channels may include undulating back walls comprised of a series of angular ridges that act to grip the lift cords contained therein. In a clamshell embodiment, the two sections are moveably joined together along one edge by a living hinge. A hole may pass through the living hinge, sized to receive and restrain a pull cord that hangs downwardly from the clamshell connector such that all the lift cords can be operated simultaneously by utilizing the pull cord.

In a second preferred embodiment, the connector comprises a plurality of distinct pieces that are joined together. At least two of the plurality of pieces include a restraint for securing a lift cord. In several alternatives, a plurality of peripheral members are attached to a center member, wherein each peripheral member includes a bore through which a lift cord is secured to the peripheral member. The center member may have a center bore through which a pull cord is secured.

In a third preferred embodiment, the connector comprises two pieces: an inner piece that has a plate portion; and an outer piece that comprises a slot to receive the plate portion. The inner piece is substantially enclosed by the outer piece. In one arrangement, notches in the plate portion and the walls of the slot form openings through which a lift cord can pass, but a knotted end of the lift cord cannot pass. In yet another arrangement, holes may pass through the plate portion for restraining a knotted end of a lift cord. A hole to restrain the knotted end of a pull cord may also be provided in either the inner or the outer piece.

DESCRIPTION OF THE PREFERRED EMBODIMENTS

Clamshell Connector Embodiment

A lift cord connector is described for individually securing the ends of a plurality of lift cords used in a covering for architectural openings, and for attaching a single pull cord to hang or depend therefrom. Accordingly, when a pull cord of a window covering assembly utilizing the connector is pulled, the bottom rail rises evenly. It is understood that although the embodiments of the connector described herein are done so with regard to a window covering assembly, embodiments of the connector may also be utilized in conjunction with other suitable types of covering assemblies for architectural openings.

Figure 1:
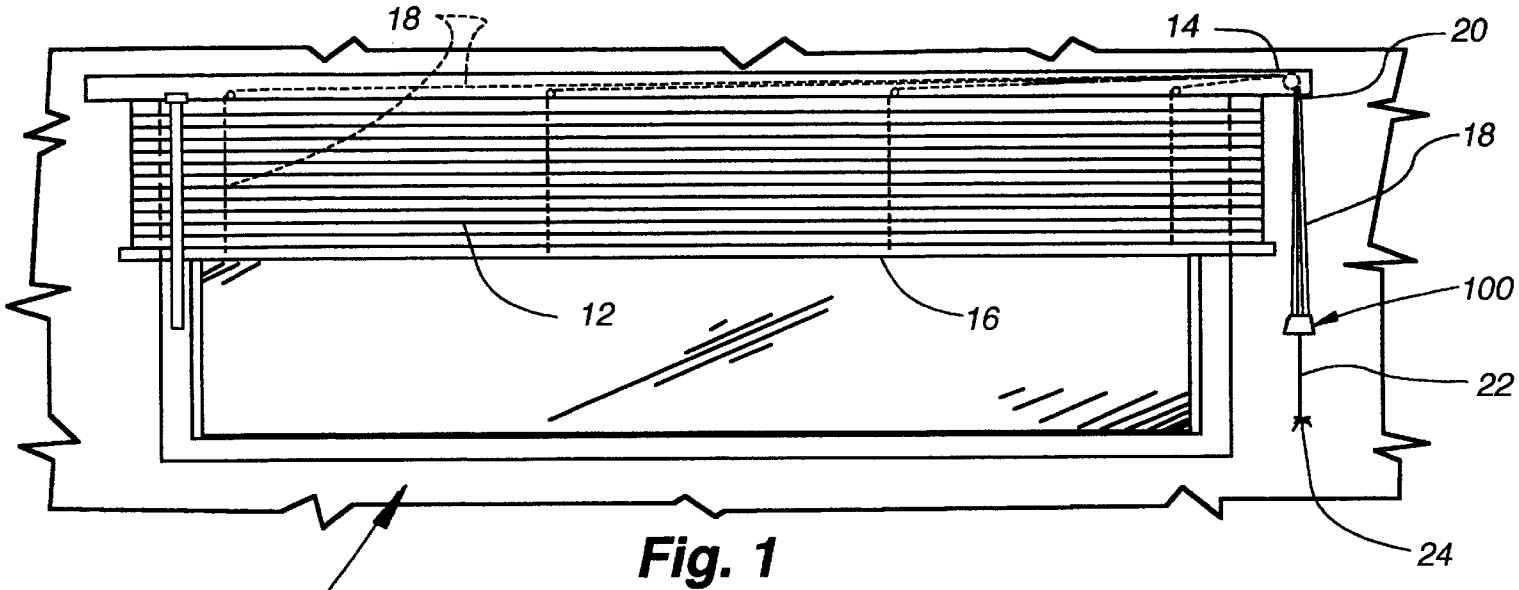
FIG. 1 is a front view of a window covering assembly incorporating an equalizing connector according to one embodiment of the present invention.
Figure 2:
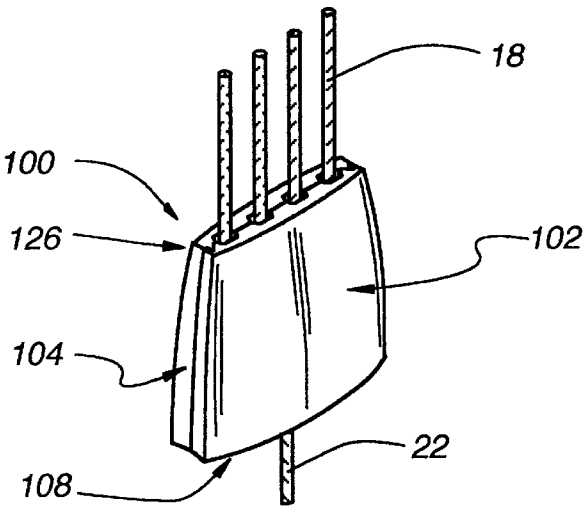
FIG. 2 is a front isometric view of an assembled clamshell equalizing connector according to one embodiment of the present invention.

FIG. 1 is an illustration of a window covering assembly 10 including a first embodiment of the lift cord connector of the present invention. The window covering 10 comprises a plurality of collapsible shade cells 12 suspended between a headrail 14 and a bottom or foot rail 16. A plurality of lift cords 18 are secured to the foot rail 16 at horizontally spaced locations. The lift cords 18 extend vertically upwardly through the shade cells 12 into the headrail 14, wherein the lift cords 18 are directed horizontally to a conventional lock mechanism 20 located proximate one end of the headrail. The lift cords 18 then pass through the lock mechanism 20 and extend downwardly until terminating in a clamshell shaped lift cord connector 100. A pull cord 22 is attached to the bottom of the connector 100 at one end and extends downwardly therefrom, terminating at the other end at a tassel member 24. Operatively, the window covering 10 is raised by pulling downwardly on the pull cord 22.

Figure 8:
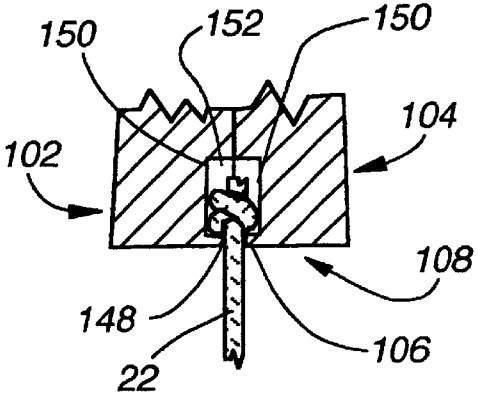
FIG. 8 is a view of the clamshell connector taken along line 8—8 of FIG. 4.
Figure 9:
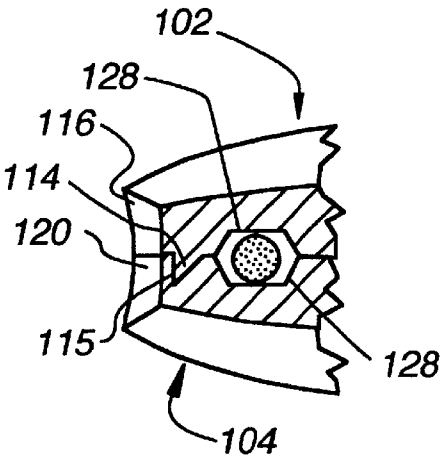
FIG. 9 is a view of the clamshell connector taken along line 9—9 of FIG. 4.

FIGS. 1–12 illustrate the clamshell lift cord connector 100. The clamshell connector 100 comprises two halves 102 and 104 connected to each other by a living hinge 106 at a bottom end 108. The connector 100 is typically molded from a suitable polymeric material as a single unit. Each half has an interior side 110 or 112 that corresponds with the interior side 110 or 112 of the other half. The two halves 102 and 104 are held together in an assembled configuration, as shown in FIG. 1, by friction fit elements, wherein a plurality of coplanar joining surfaces 113 on each interior side 110 or 112 are in direct contact with adjacent coplanar joining surfaces 113 on the other interior side 110 or 112. As is best shown in FIG. 8, the friction fit elements include (i) protrusions 114 that project from the interior side 110 of one half 102 adjacent to and extending along the left and right sides 116 and 118 of the half 102, and (ii) mating depressions 115 on the interior side 112 of the other half 104 that extend along the left and right sides 120 & 122 of the other half 104. The protrusions 114 and depressions 115 are designed to securely hold the halves 102 and 104 together. In alternative configurations of the clamshell embodiment, appropriate snap fit elements or any other suitable means for fixing the two halves 102 and 104 together may be substituted for the friction fit elements, including but not limited to rivets, screws, clamps and adhesives.

Figure 6:
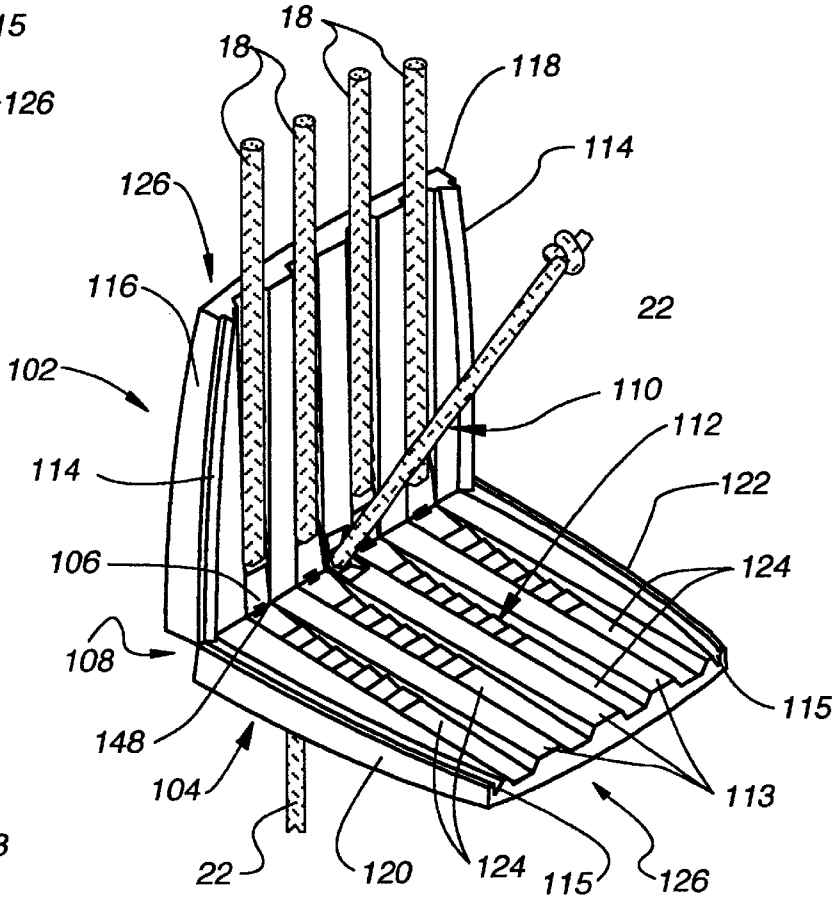
FIG. 6 is an isometric view of the interior sides of the respective halves of the clamshell connector with lift and pull cords contained therein according to one embodiment of the present invention.
Figure 3:
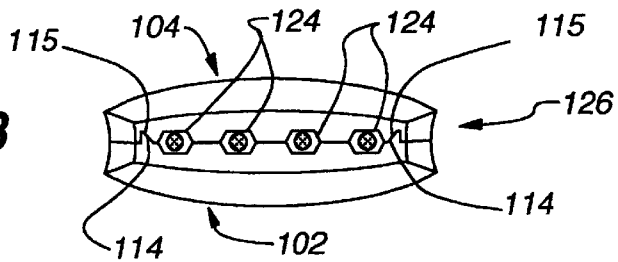
FIG. 3 is a top view of a clamshell connector according to one embodiment of the present invention.
Figure 4:
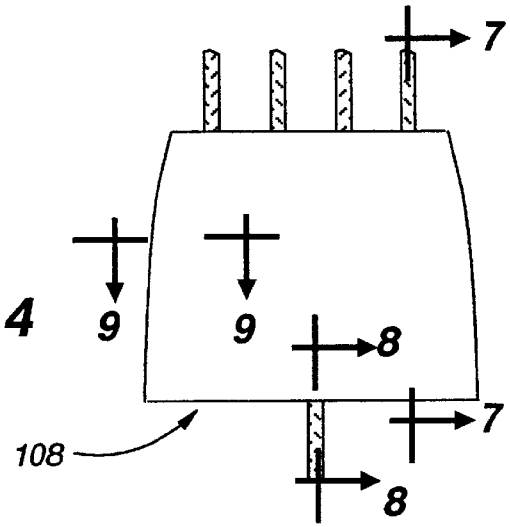
FIG. 4 is a side view of the clamshell connector according to one embodiment of the present invention.
Figure 5:
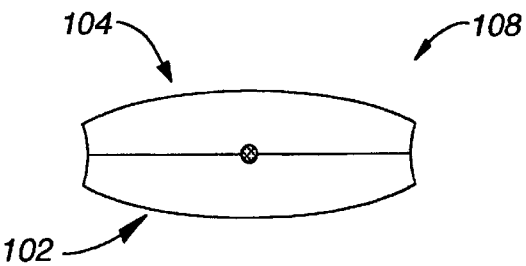
FIG. 5 is a bottom view of a clamshell connector according to one embodiment of the present invention.
Figure 10:
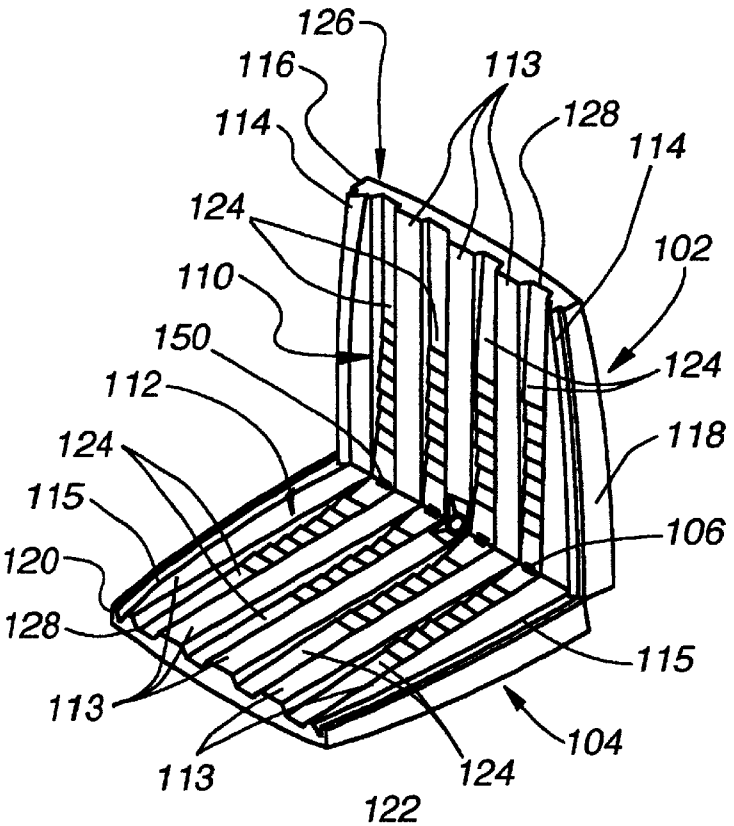
FIG. 10 is an isometric view of the interior sides of the respective halves of the clamshell connector according to one embodiment of the present invention.

Except for the friction fit elements described above, the interior sides 110 and 112 of the halves 102 and 104 are very similar. Each interior side 110 and 112 comprises a plurality of vertically orientated generally U-shaped channels 124 disposed therein that extend from the living hinge 106 to an open end or edge 128 at the topside 126 of each half. Clamshell connector 100 has four channels 124 disposed in each half as illustrated in FIGS. 6 and 10; however, clamshell connectors with any number of channels are contemplated depending on the number of lift cords 18 that the clamshell connector must secure.

Figure 11:
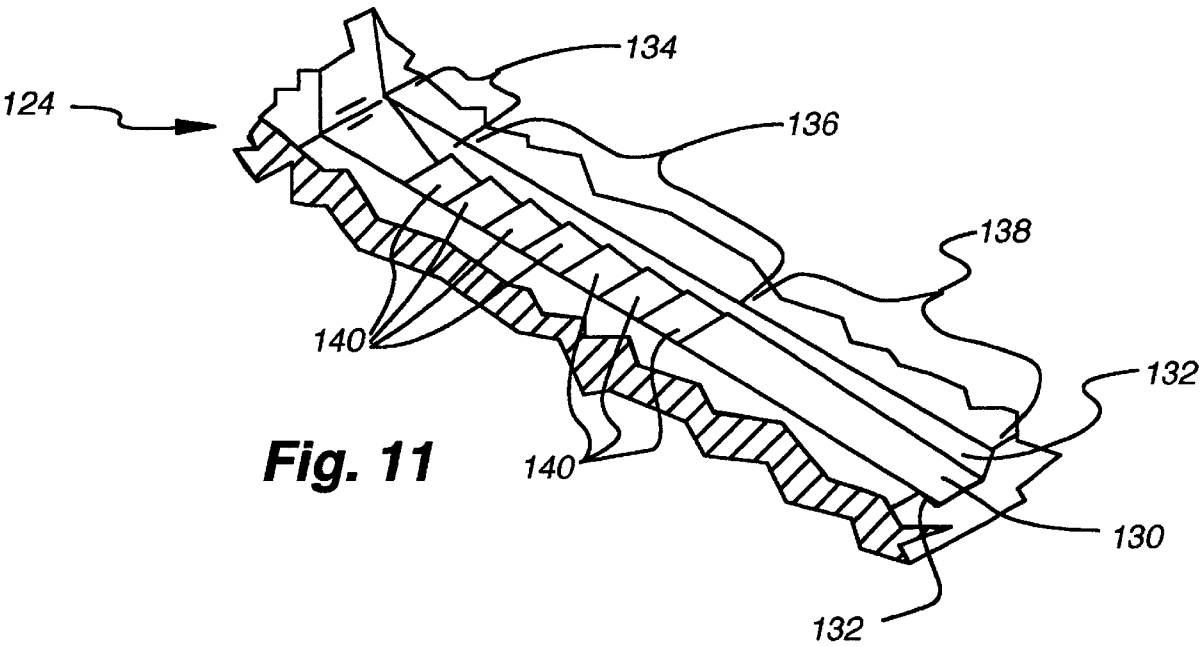
FIG. 11 is an enlarged fragmentary view of a channel of the clamshell connector according to one embodiment of the present invention.

Referring to FIG. 11, each U-shaped channel 124 comprises a backside wall 130 intersected by spaced sidewalls 132. The sidewalls 132 may intersect with the backside wall 130 at a right angle or at an obtuse angle as shown. Each channel 124 is essentially divided into three sections. The first section 134 located adjacent the bottom end 108 of the half, and extends only a small portion of the length of the channel 124 (e.g. 1/10 the length). The sidewalls 132 in the first section rise above the backside to a height that is equivalent to or slightly greater than the radius of a lift cord 18.

Figure 12:
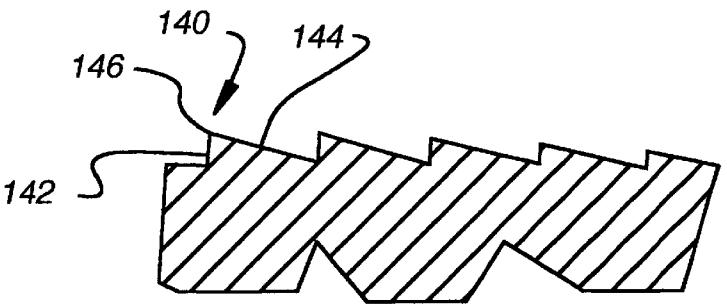
FIG. 12 is fragmentary cross sectional view of several angular ridges of the clamshell connector.

The second section 136 comprises approximately half the length of the channel 124 beginning from the top of the first section 134 and terminating at the bottom of the third section 138. The second section 136 is serrated and characterized by an undulating series of angular ridges 140 that protrude from the backside and extend across the channel 124. An enlarged cross-section of several angular ridges is illustrated in FIG. 12. Each ridge is defined by (i) a first surface 142 that rises from the bottom of the backside wall 130 and is substantially perpendicular to the vertical length of the channel 124, and (ii) a second surface 144 that projects downwardly from the bottom of the backside wall 130 at an acute angle relative to the channel length toward a convergence with the first surface 142 to form an apex 146 of the ridge 140. Starting with the first angular ridge adjacent the first section 134, each successive ridge 140 of the series of angular ridges within each channel has a height relative to the backside wall 130 that is less than the angular ridge 140 proceeding it. The height of the first angular ridge 140 is typically less than the radius of a lift cord 18.

The third section 138 comprises a backside wall 130 with an essentially smooth surface that begins at the top of the second section 136 and terminates at the open end 128 of the channel 124 extending just under ½ the length of the channel. From the beginning of the third section the backside wall 130 diverges at a slight acute angle away from the joining surfaces 113 of the interior side, such that the height of the spaced sidewalls 132 in the third section 138 increases until a maximum sidewall height is reached. In an upper portion of the third section 138, the backside wall 130 is parallel with the joining surfaces 113 and the sidewall height is maintained at the maximum sidewall height, wherein the maximum sidewall height is greater than the radius of a lift cord 118.

Figure 7:
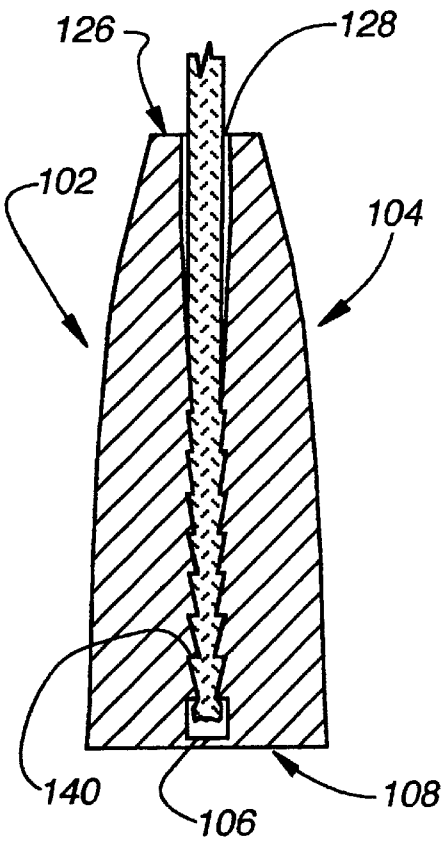
FIG. 7 is a view of the clamshell connector taken along line 7—7 of FIG. 4.

Proximate the side to side center of the clamshell connector 100, a hole 148 having a diameter slightly greater than the diameter of a pull cord 22 passes through the living hinge 106. A small depression 150 proximate the hole 148 is formed in the interior side 110 and 112 of each half 102 and 104. When the halves are joined in the assembled configuration the two depressions 150 form a small cavity 152 as shown in FIG. 7, wherein a knotted end of a pull cord 22 may be held.

Operatively, the tips of the lift cords 18 are generally horizontally aligned relative to each other and placed within the channels 124 such that each lift cord tip is resting within the first section 134 of its respective channel 124. A pull cord 22 is threaded through the hole 148 in the living hinge 106, and the knotted end of the pull cord 22 is placed between the corresponding depressions 150 adjacent to the hole 148. The two halves 102 and 104 are then brought together until the respective joining surfaces 113 meet and the protrusions 114 on one half 102 frictionally mate with the depressions 115 on the other half 104 to fixedly join the halves in the assembled configuration. As is illustrated in FIGS. 1,2,6 and 8, the corresponding channels 124 from each half form linear receptacles to contain the end portions of the lift cords. As seen especially in FIG. 6, the series of angular ridges 140 from corresponding channels 124 line up with each other to deform the portions of the lift cord 18 located between apexes 146 of two opposing ridges 140. It can be appreciated that by applying a downwardly directed force to the clamshell connector by pulling on the pull cord 22, the angular ridges 140 will act as teeth preventing slippage between the connector 100 and the lift cords 18.

Many variations on the clamshell connector design described herein are possible without deviating from the scope of the invention. Specifically, the two halves may be joined together using any suitable means, as discussed above. The living hinge may be replaced by another type of hinge or connector. In certain alternative embodiments, the two halves may not even be joined in a clamshell configuration; rather, they may comprise two completely separate pieces that are connected together only when assembled. Additionally, lift cord channels of numerous variations are possible. For instance, the angular ridges may be configured differently, wherein the ridges of corresponding channels are offset relative to each other rather than in direct opposition. In another variations, the ridges could comprise barbs, or only one of two corresponding channels may have ridges.

Multi-Piece Connector

FIGS. 13–18 illustrate a second preferred embodiment of a lift cord connector. In this embodiment, a separate and distinct cord-securing member is provided for each lift cord 18 and pull cord 22 that is utilized in a window covering assembly 10. The illustrated version of this embodiment is designed for use in a window covering assembly 10 having four lift cords 18; however, other variations for window cover assemblies having more or less lift cords 18 are contemplated. Each lift cord 18 is secured to its respective cord-securing member, and then the sections are assembled to form a single operative lift cord connector.

Figure 18:
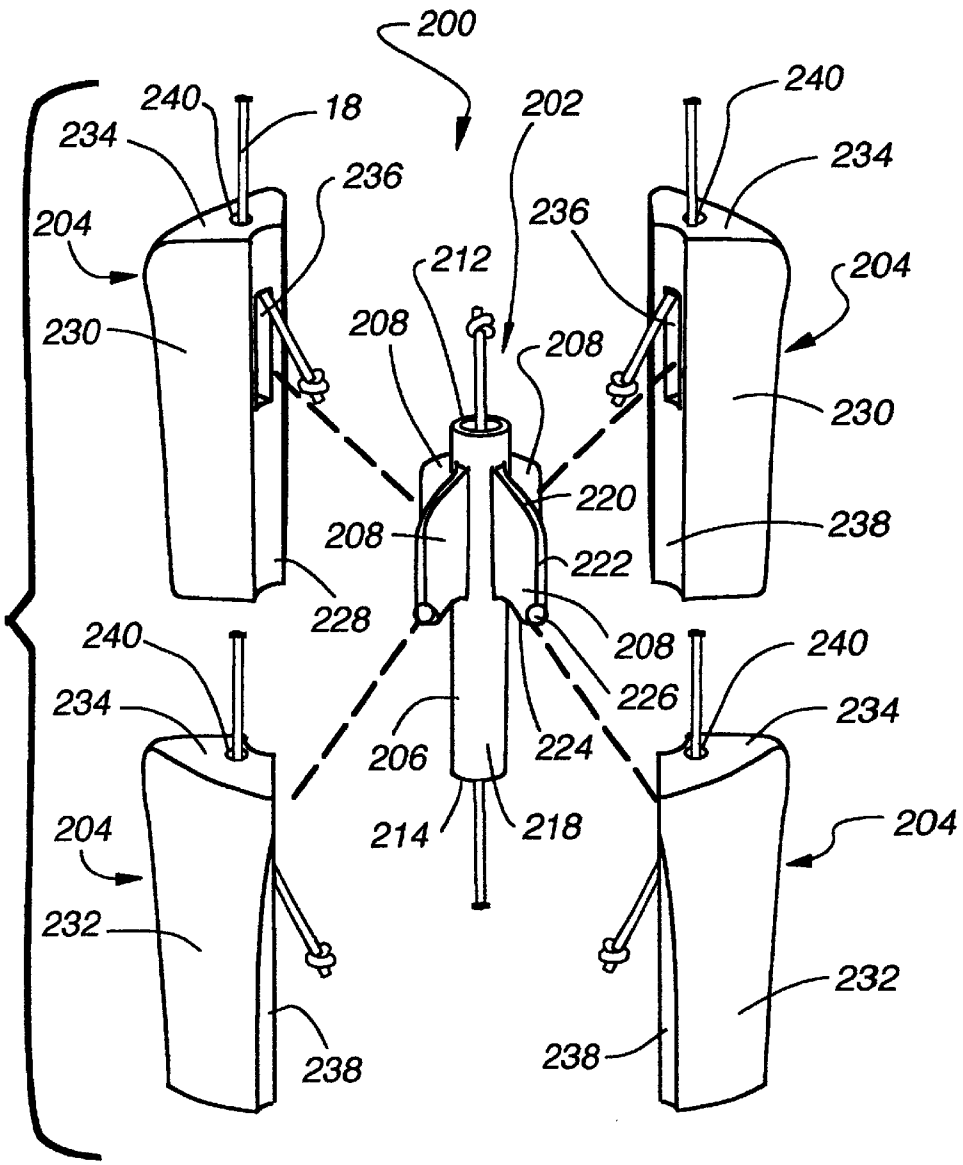
FIG. 18 is an exploded isometric view of the multi-piece connector according to one embodiment of the present invention.
Figure 17:
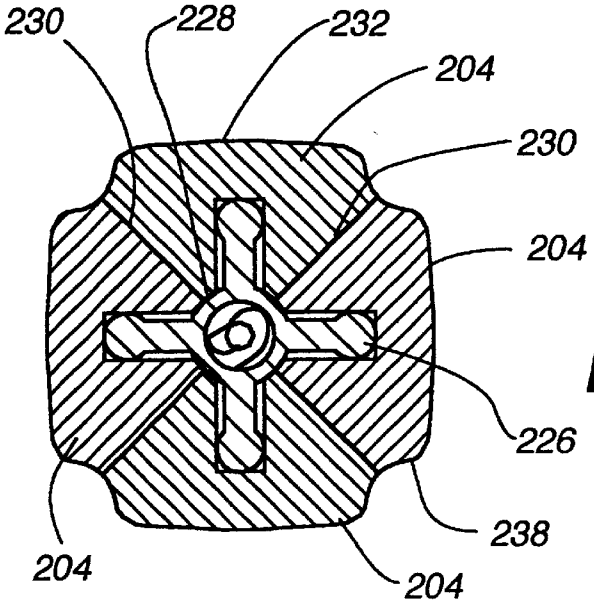
FIG. 17 is a cross sectional view of an assembled multi-piece connector taken along line 17—17 of FIG. 16.
Figure 20:
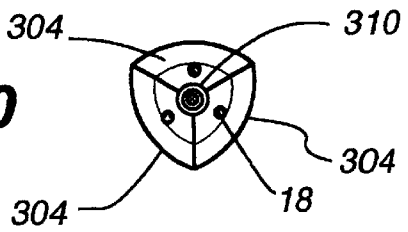
FIG. 20 is a top view of an assembled multi-piece connector according to another embodiment of the present invention.
Figure 21:
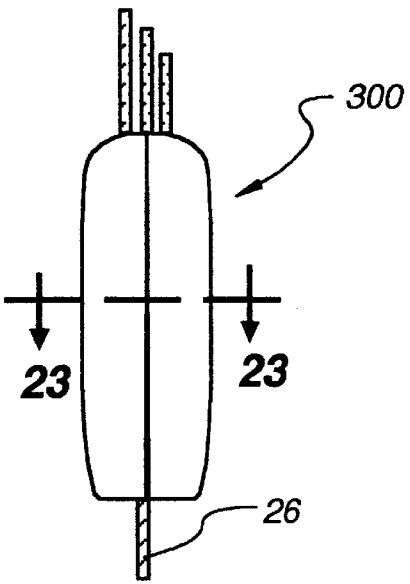
FIG. 21 is a side view of an assembled multi-piece connector according to another embodiment of the present invention.
Figure 22:
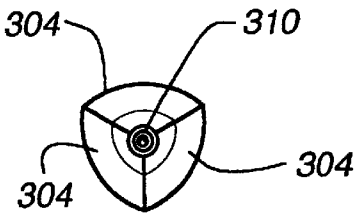
FIG. 22 is a bottom view of an assembled multi-piece connector according to another embodiment of the present invention.
Figure 19:
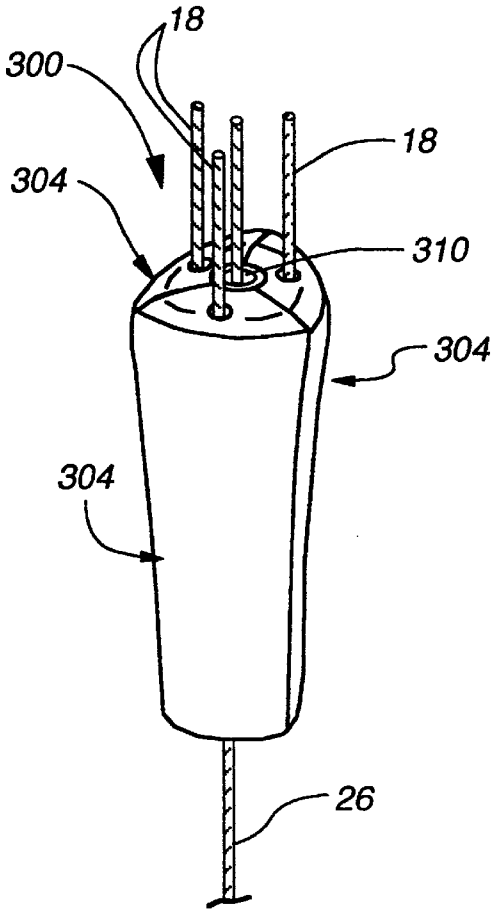
FIG. 19 is an isometric view of an assembled multi-piece connector according to another embodiment of the present invention.

FIG. 18 provides a view of the cord connector 200 prior to assembly. Center pull cord-securing member 202 (hereafter "center member") and four identical peripheral lift cord-securing members 204 (hereafter "peripheral members") are provided.

Figure 16:
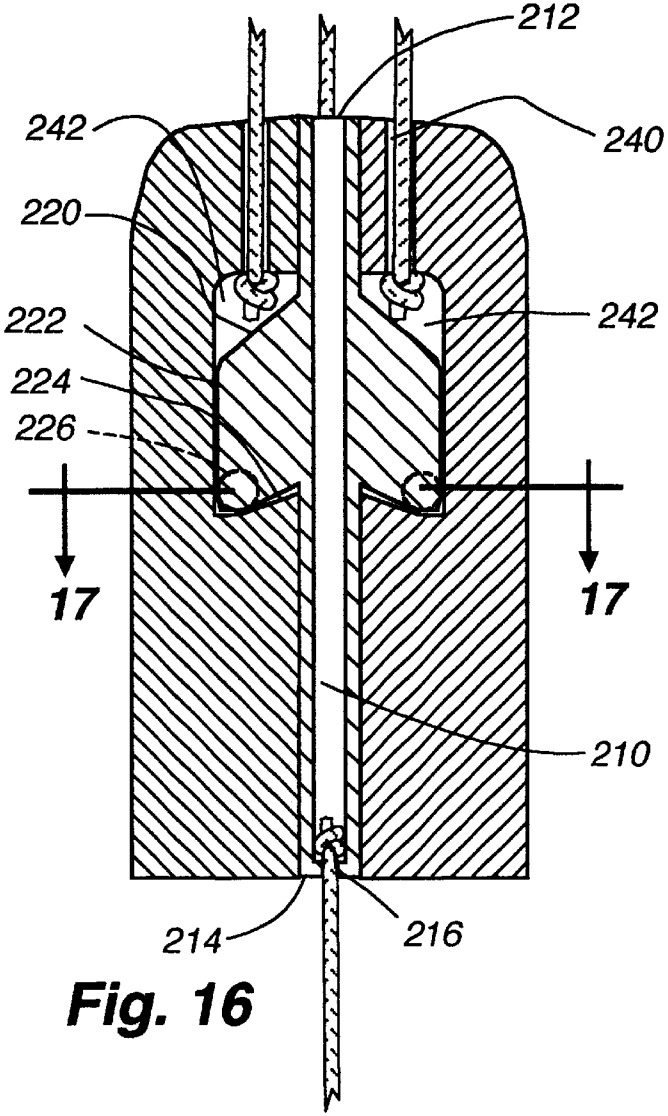
FIG. 16 is a cross sectional view of an assembled multi-piece connector taken along line 16—16 of FIG. 14.
Figure 14:
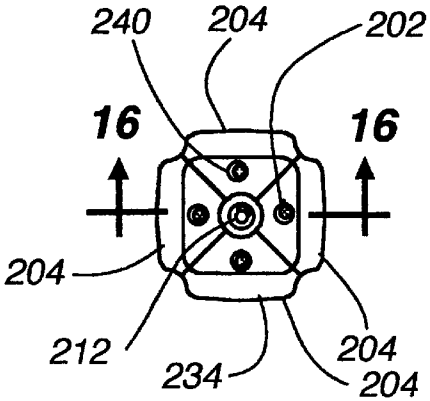
FIG. 14 is a top view of an assembled multi-piece connector according to one embodiment of the present invention.
Figure 15:
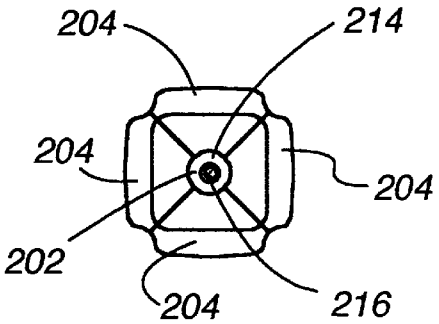
FIG. 15 is a bottom view of an assembled multi-piece connector according to one embodiment of the present invention.
Figure 13:
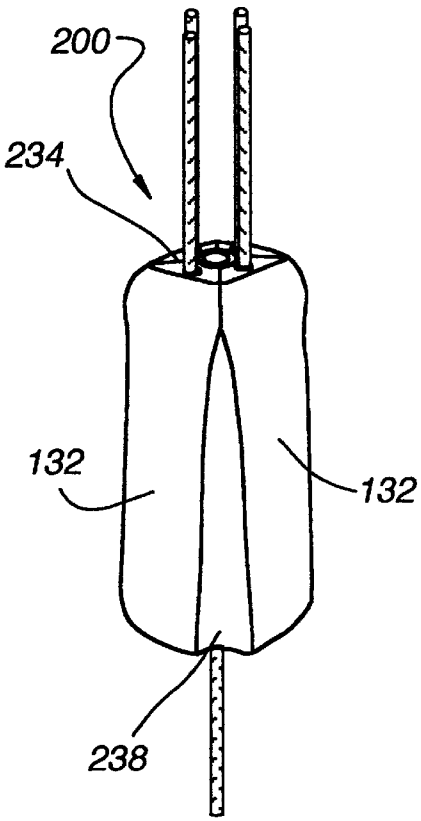
FIG. 13 is an isometric view of an assembled multi-piece connector according to one embodiment of the present invention.

The center member 202 comprises a cylindrically-shaped tubular body 206 with four radially disposed fin members 208 attached thereto. The center member 202 is typically molded from a suitable polymeric material. The interior bore 210 of the tubular body 206, as best seen in FIG. 16, is open at an upper end 212 and partially closed at a lower end 214. The partially closed lower end 214 defines a hole 216 passing therethrough with the hole 216 having a diameter only slightly greater than the diameter of a pull cord 22. The substantially identical fin members 208 are circumferentially spaced 90 degrees apart from each other about the exterior surface 218 of the tubular body 206. Each fin member 208 has (i) a downwardly and outwardly extending top edge 220, (ii) substantially vertical side edge 222, (iii) a bottom edge 224, and (iv) a beaded element 226 proximate the intersection of the side edges 222 and bottom edges 224 with a diameter that is typically greater than the thickness of the remaining portions of fin member.

Each peripheral member 204 has (i) a concave inside surface 228, (ii) two side surfaces 230, (iii) a back surface 232, and (iv) top surface 234. Each peripheral member 204 is typically molded from the same polymeric material as the center member 202. The concave inside surface 228 is configured to match up against the corresponding portion of the exterior surface 218 of the tubular body 206. The concave inside surface 228 has a fin slot 236 disposed thereon. The fin slot 236 is configured to receive one of the fin members 208, wherein the width of the fin slot 236 is slightly less than the diameter of the beaded element 226.

The two side surfaces 230 are disposed perpendicularly to each other, wherein each side surface is configured to match up against an adjacent side surface 230 of another peripheral member 204 when the connector 200 is assembled. The backside surfaces 232 of the peripheral members 204 form the exterior surface of the assembled connector 200. Accordingly, the geometry of the backside surface 232 may be varied to provide an aesthetically appealing and functional exterior surface. For instance, the backside surface may be tapered, or it might include scalloped edges 238 that serve as fingerholds. As best seen in FIG. 16, a lift cord bore 240 extends from the fin slot 236 to the top surface 234. The lift cord bore has a diameter slightly greater than that of a lift cord 18.

Operatively, each of the lift cords 18 is threaded through the lift cord bore 240 and into the fin slot 236 of a peripheral member 204. A knot is tied at the end of each lift cord 18 to secure it against the bottom of the lift cord bore 240. A pull cord 22 is threaded through the hole 216 at the lower end 214 of the center member 202, and knotted to secure it in place against the lower end 214. The fin slot 236 of each peripheral member is slid over a fin 208 of the center member until the inside surface 228 of the peripheral member is adjacent the exterior surface 218 of the center member. Each peripheral member 204 is held in place on the center member 202 by an interference fit between the beaded member 226 of the fin member 208 and the sides of the fin slot 236. As the peripheral members 204 are attached to the center member 202, adjacent side surfaces 230 meet and the backside surfaces 232 form the exterior surface of the assembled connector 200.

Referring specifically to FIG. 16, the junction of a fin member 208 and a fin slot 236 form a knot cavity 242 bounded by the downwardly extending top edge 220 of the fin member 208 and the corresponding sides of the fin slot 236. The knot cavity 242 provides a space in which the knotted end of a lift cord 18 may be contained. In the preferred embodiment of the connector 200, as shown in FIG. 16, the fin member bottom edges 224 and the fin slot bottom surfaces may extend downwardly away from the tubular body 206, wherein when assembled the bead 226 rests in a low point in the fin slot 236. Accordingly, the probability of the peripheral member 204 separating from the center member 202 is reduced, since the peripheral member must be moved both up and away from the center member to remove it.

Many alternatives of connector 200 are possible without deviating from the scope of the invention. One variation is illustrated in FIGS. 19–24, wherein a connector 300 comprises three peripheral members 304 instead of the four peripheral members described above. It is understood that in other embodiments, a connector may have two peripheral members or five or more peripheral members depending on the number of lift cords on the particular window covering assembly on which the connector is to be utilized.

As is shown in FIGS. 19–24, most of the features described above are incorporated in the three peripheral member alternative. The primary distinction between the four member and three member alternatives, aside from the number of peripheral members, is that the angle of incidence between the peripheral member side surfaces 338 is increased to 120 degrees. In general, when substantially identical peripheral members are utilized, the angle of incidence between the side surfaces is equal to 360 degrees divided by the number of peripheral members.

Figure 24:
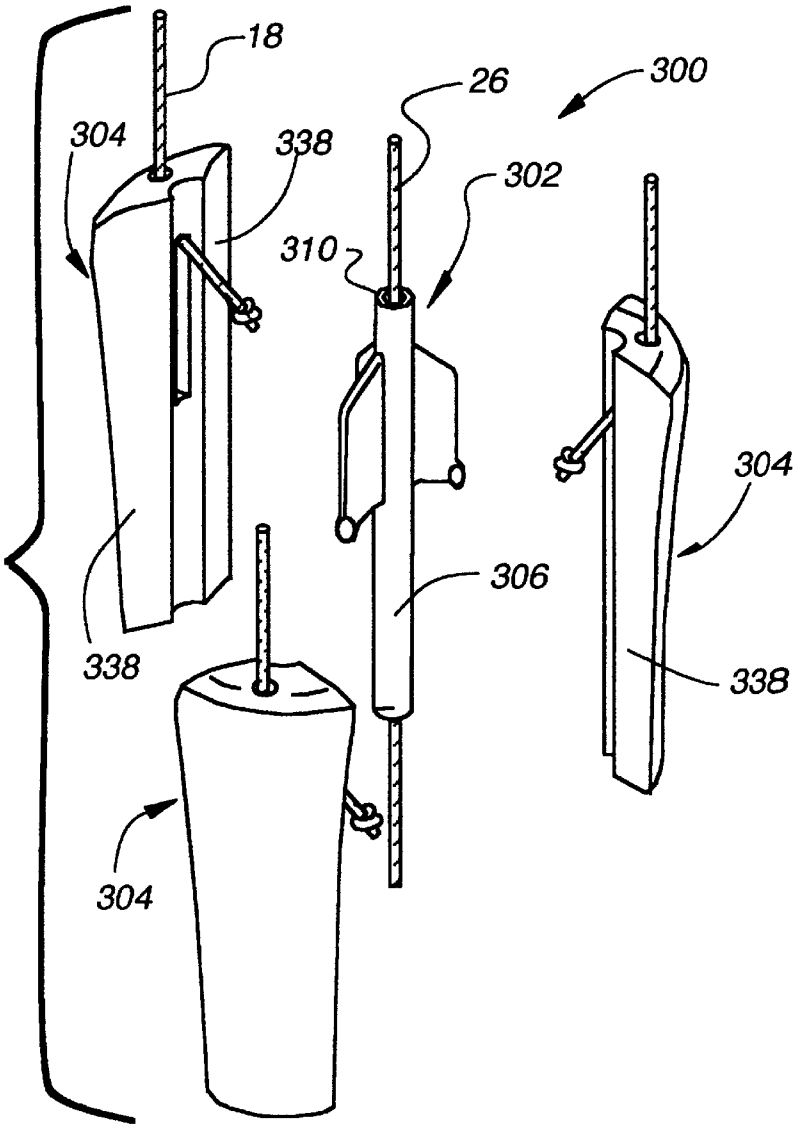
FIG. 24 is an exploded isometric view of the multi-piece connector according to another embodiment of the present invention.
Figure 23:
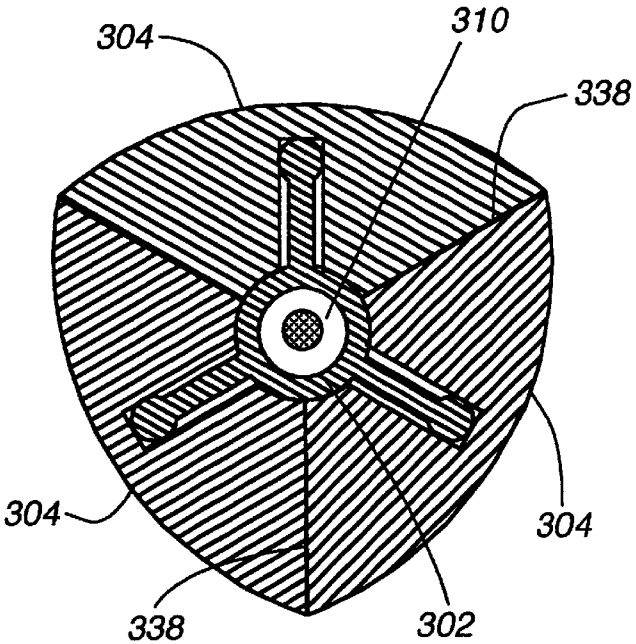
FIG. 23 is a cross sectional view taken along line 23—23 of FIG. 21.

Another distinction over the four peripheral member connector is that the center member 302, as clearly illustrated in FIGS. 23 and 24, is not adapted for securing a pull cord 22 within the interior bore 310 of the tubular body 306. Rather, a guide rope 26 passes through the interior bore 310 vertically unhindered. When a guide rope 26 is utilized in a window covering assembly 10, it will typically be fixedly attached to the headrail 14 of the covering assembly 10 on one end and a windowsill on the other end. Without the pull cord 22, the window covering is raised by pulling the connector 300, which may also be referred to as a tassel, along the guide rope 26.

It is to be appreciated that either the three or four peripheral member alternative may utilize a center member adapted for a pull cord or one that is not. Likewise, either alternative may utilize a center member without a bore passing through the center member, wherein neither a pull cord nor a guide rope is utilized. Furthermore, the manner in which a pull cord attaches to the connector may be different then described herein. For instance, the length of the center member may extend beyond the bottom sides of the peripheral members and have a horizontal bore passing through the extended portion through which a pull cord may be attached.

In another alternative, the manner in which the lift cords are attached to the connector may vary. Additionally, the manner in which the peripheral members are attached to the center member may vary. In one such variation, snap fit elements are utilized to connect the center and peripheral members. In yet another variation, the various cord securing members could be joined together directly, with or without the use of a center section.

2-Piece Connector

FIGS. 25–37 illustrate a third embodiment connector 400 comprising two interrelated components. When assembled this connector has a generally triangular cross section perpendicular to its length, wherein the sides of the triangle are slightly curvilinear. Referring to FIG. 29, the shape of the connector is reminiscent of an elongated teardrop, wherein the assembled connector is widest at a location between its top and bottom.

Figure 27:
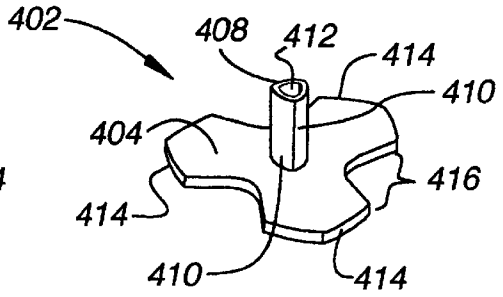
FIG. 27 is an isometric bottom view of an internal member of a two-piece connector according to another embodiment of the present invention.
Figure 26:
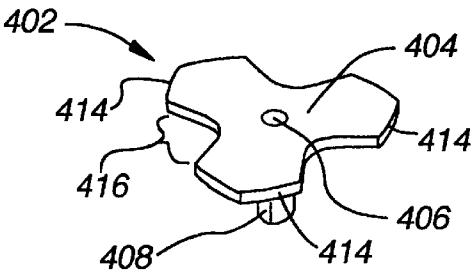
FIG. 26 is an isometric top view of an internal member of a two-piece connector according to another embodiment of the present invention.

FIGS. 26 and 27 illustrate a internal member 402 comprising a plate portion 404 wherein a hole 406 passes through the approximate center of the plate portion 404. The hole 406 has a diameter slightly greater than the diameter of an associated lift cord 18. Extending downwardly from the bottom side of the plate portion 404 is a hollow shaft 408 wherein the three curvilinear sides 410 of the shaft 408 define a generally triangular cross section. Although the interior bore 412 of the hollow shaft 408 is shown as having a generally triangular cross section, the bore 412 could have any suitable shape so long as a knotted end of a lift cord 18 can be deposited therein. The shaft 408 is generally concentric with the hole 406. The plate portion 404 has a generally triangular shape with curvilinear side edges 414, each side edge 414 having removed therefrom a generally V-shaped notch 416 at a location proximate the midpoint between two vertices of the side edge 414.

Figure 28:
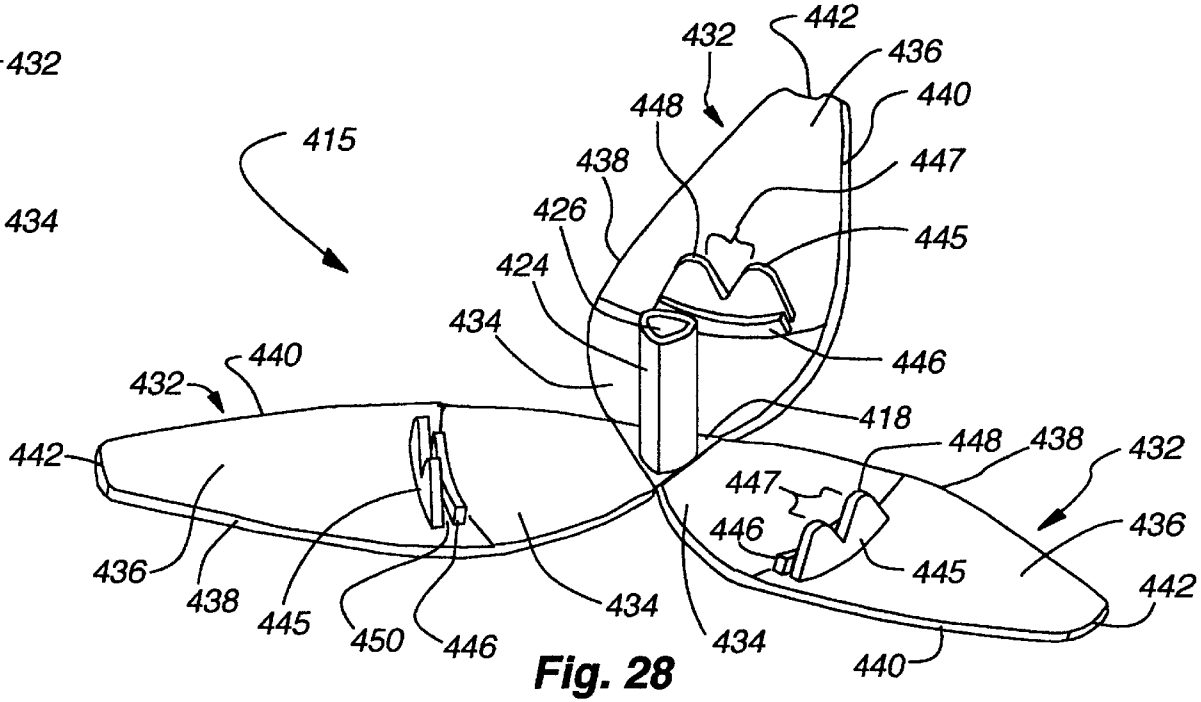
FIG. 28 is an isometric view of the internal surfaces of an exterior member of the two-piece connector according to another embodiment of the present invention.
Figure 25:
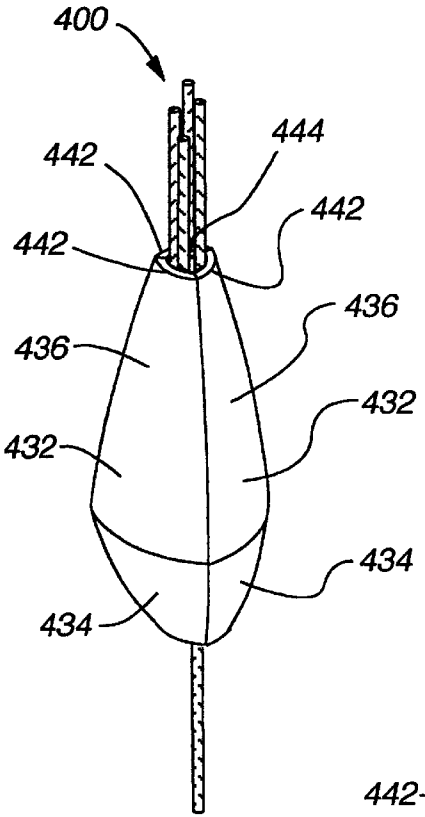
FIG. 25 is an isometric side view of an assembled two-piece connector according to one embodiment of the present invention.
Figure 31:
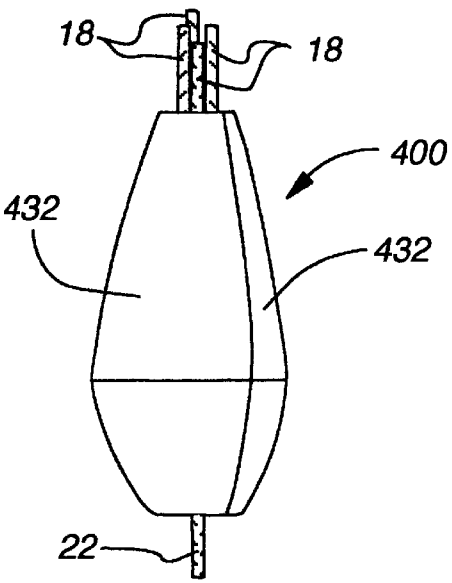
FIG. 31 is a side view of an assembled two-piece connector according to one embodiment of the present invention.
Figure 32:
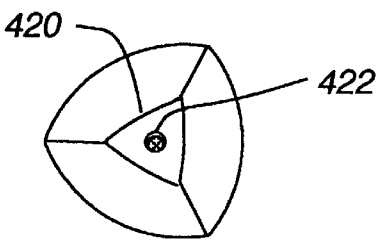
FIG. 32 is a bottom view of an assembled two-piece connector according to one embodiment of the present invention.
Figure 30:
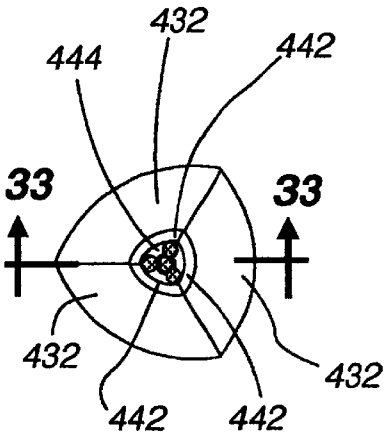
FIG. 30 is a top view of an assembled two-piece connector according to one embodiment of the present invention.
Figure 29:
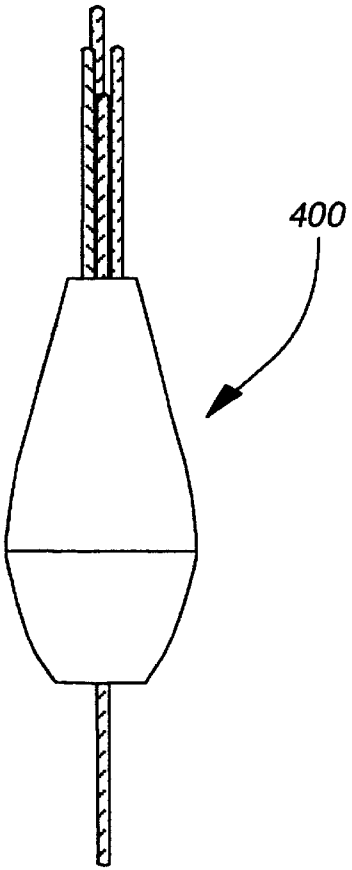
FIG. 29 is a view of one of the three side sections of a two-piece connector when assembled according to one embodiment of the present invention.
Figure 34:
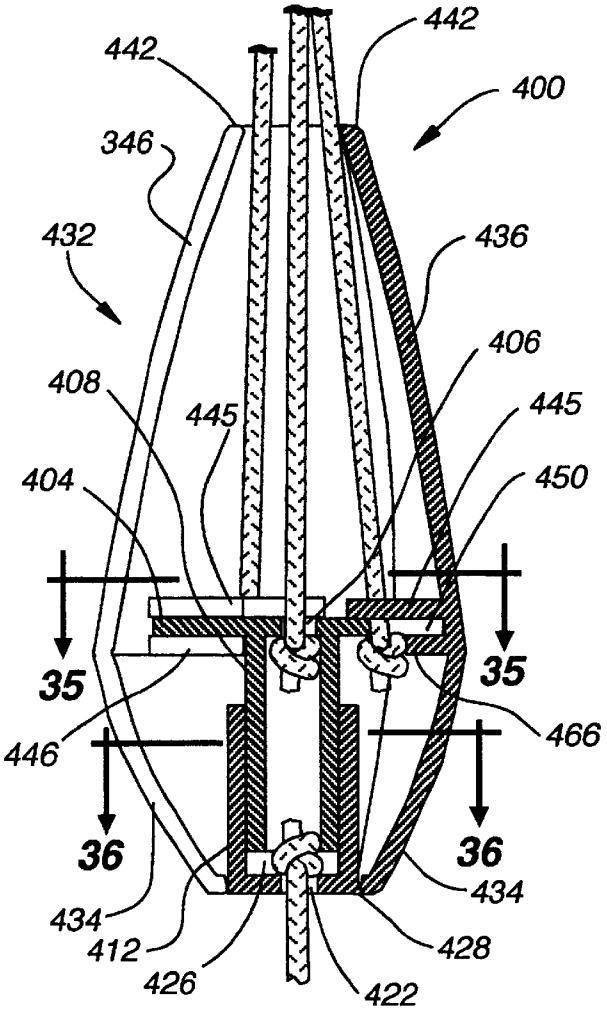
FIG. 34 is an exploded isometric view of an unassembled two-pieced connector according to one embodiment of the present invention.

FIGS. 28 and 34 illustrate an external member 415 in its unassembled configuration. The external member 415 is typically molded from as a single unit from a suitable polymeric material such as polypropylene. The external member 415 has a plate-like base portion 418 having a triangular shape with slightly curvilinear sides 420. A hole 422 extends through the approximate center of the base 418 as is shown in FIG. 32, wherein the hole 422 has a diameter slightly greater than the diameter of an associated pull cord 22. A hollow shaft 424 extends upwardly from the base 418 generally concentric with the hole 422. The bore 426 of the shaft 424 has a generally triangular cross section corresponding to the exterior cross section of the downwardly extending hollow shaft 408 of the internal member 402, whereby the internal member hollow shaft 408 may be slideably received in the bore 426 of the external member shaft 424. Although the shafts 408 and 424 illustrated herein are triangular in cross section, shafts with different cross sections would be suitable. Preferably, the shafts would have a shape that facilitated quick and easy connection of the plate portion 404 to the corresponding structure in the external member 415.

Attached to the sides 420 of the base portion 418 by way of living hinges 428 are the bottom edges of three substantially identical side members 432. Each side member 432 comprises a lower wall section 434, and an upper wall section 436, wherein each wall section has an interior and exterior surface. The lower wall section 434 of each side member 432 includes a left and right edge 438 and 440 respectively that when viewed in an assembled position extend generally vertically and to a lesser degree outwardly from the base side 418. The edges 438 and 440 are slightly convex relative to a center axis of the external member shaft 424. Furthermore, the surfaces of the lower wall section 434 are also slightly horizontally convex. The lower wall 434 terminates and intersects with the upper wall 436 at a location about a third of the length of the side member 432 from the base 418. At this location, the horizontal distance between the left and right edges 438 and 440 is at its greatest. From the intersection of the lower and upper wall sections, the left and right edges 438 and 440 of the upper wall section 436 extend generally vertically and to a lesser degree inwardly towards the center axis. As is the case with the lower wall 434, the edges of the upper wall 434 are also slightly convex relative to the center axis. The surfaces of the upper wall section 436 are also slightly horizontally convex. The upper wall section 436 terminates at an upper edge 442. When the three sides members 432 are assembled, the left edges 438 meet and contact along their entire lengths the right edges 436 of a corresponding side member 432, and the three upper edges 442 meet to from a triangularly shaped upper opening 444 through which the plurality of lift cords 18 pass into the interior of the assembled connector 400. It is contemplated that one edge 438 or 440 on each side member 432 may include a small tongue shaped protrusion to be received in a corresponding groove in the adjacent edge 438 or 440 when the external member 415 is assembled.

Figure 33:
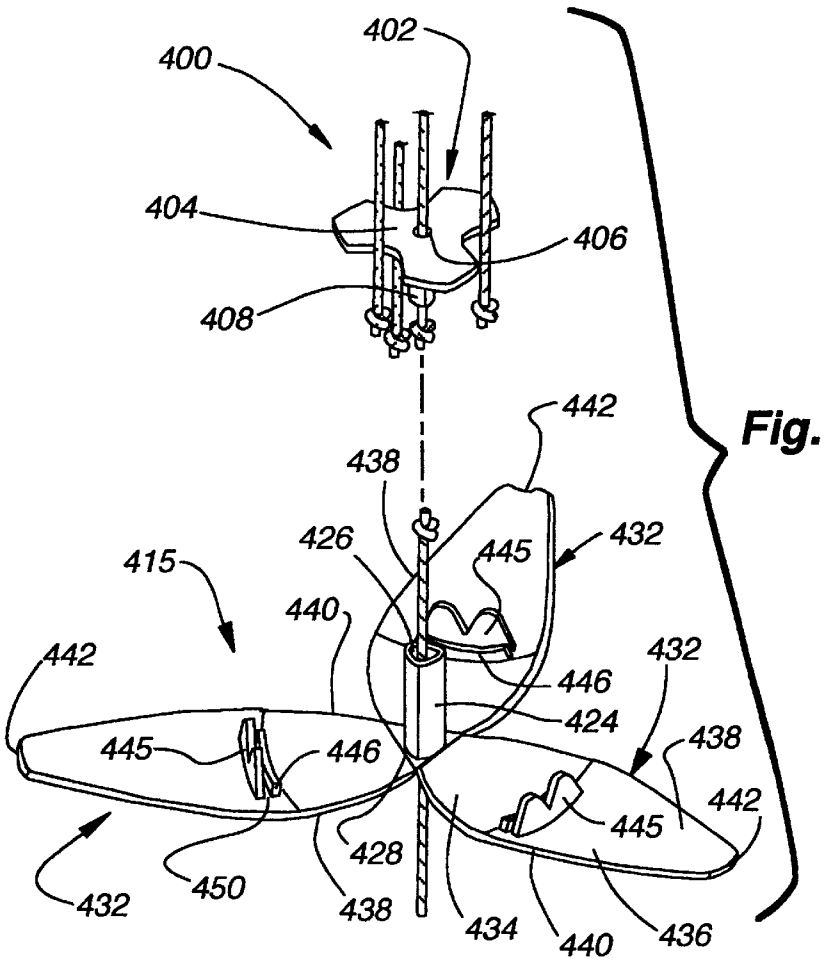
FIG. 33 is a cross sectional view taken along line 33—33 of FIG. 30.
Figure 36:
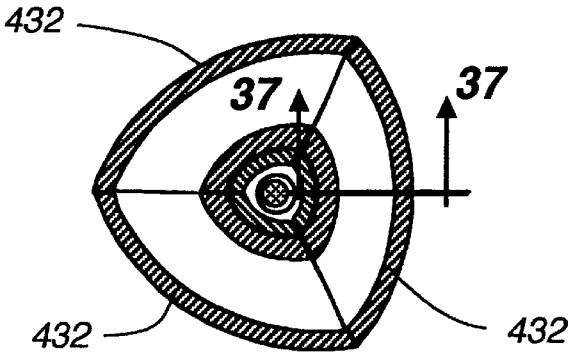
FIG. 36 is a cross sectional view taken along line 36—36 of FIG. 33.
Figure 37:
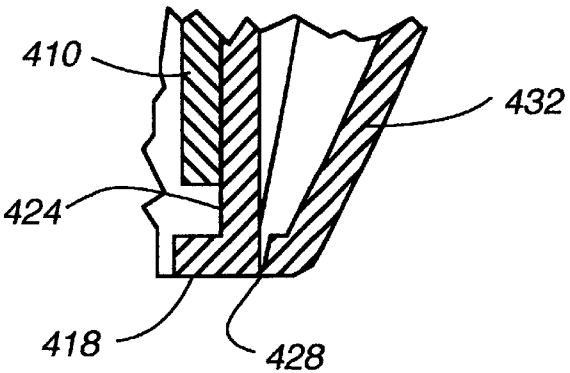
FIG. 37 is a fragmentary cross sectional view taken along line 37—37 of FIG. 36.

Two substantially horizontal and parallel ledges 445 and 446 extend from the interior surface of each upper wall section 436 proximate the intersection of the lower wall section 434 with the upper wall section 436. The ledges 445 and 446 are substantially centered between the left and right edges 438 and 440 respectively. The upper ledge 445 has a V-shaped notch 447 removed from the center of the upper ledge's front edge 448. The lower ledge 446 extends away from the interior surface a first distance that is less than a second distance between the vertex of the V-Shaped notch 447 and the interior surface of the upper wall section 436. The spacing between the first and second distances being roughly the same as half the diameter of a lift cord knot. The two ledges 445 and 446 are spaced from each other to form a ledge slot 450 as is shown in FIG. 33. The height of the ledge slot 350 corresponds directly to the thickness of the plate portion 404 of the internal member 402, wherein a portion of the plate portion 404 of the internal member 402 may be slideably received into the ledge slot 450 and retained therein by friction or an interference between the plate portion 404 and the slot 450.

Operatively, a knotted end of the pull cord 22 is threaded through the hole 422 in the base 418 of the external member 415, wherein the pull cord 22 knot rests against the interior surface of the base 418 as shown in FIGS. 33 and 34. As also shown in FIGS. 33 and 34, one lift cord 18 of the four lift cords is threaded through the hole 406 in the plate portion 404 of the internal member 402 and knotted, wherein the knot is contained within the downwardly extending shaft 408 and restrained by the bottom surface of the plate portion 404. Knotted end portions of the remaining three lift cords 18 are arranged in the notches 416 of the plate portion 404 as shown in FIG. 33. The internal member shaft 408 is slid into the external member shaft 424. Each exterior side surface 410 of the internal member hollow shaft 408 corresponds to and is generally parallel to a notched edge 414 of the triangularly shaped plate portion 404. Likewise, the interior sides of the external member shaft 424 correspond with the side members 432 of the external member 415. Accordingly, when the shafts 408 and 424 are coupled, each notched edge 414 of the plate portion 404 directly corresponds to a side member 432 of the external member 415, and each vertex of formed by the intersection of two edges 414 of the plate portion 404 matches up with a pair of adjacent side edges 438 and 440. Next, each of the side members 432 of the external member 415 are raised and pivoted about the living hinge until the notched edge 414 of the plate portion 404 is received into the ledge slot 450 and bottoms out against the interior surface of the upper wall 436 of a side member 432.

Figure 35:
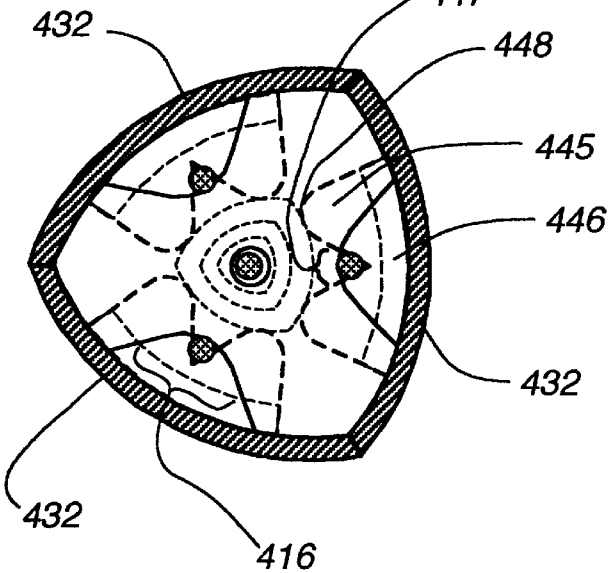
FIG. 35 is a cross sectional view taken along line 35—35 of FIG. 33.

The interrelationship between the internal member 402 and the external member 415 in an assembled connector is best shown in FIGS. 34 and 35. The opposing ledge notches 446 and plate portion notches 416 form openings that are sized to allow the lift cords 18 to pass therethrough while not allowing the knotted ends of the lift cords 18 to pass therethrough, thereby securing three lift cords 18 within the connector 400. The plate portion 404, with a forth lift cord 18 restrained therein, is secured against upward movement during operation of the window covering assembly 10 by the overhanging upper ledge 445. The internal member 402 and external member 415 of the connector are held together in the assembled position by the interference or friction fit between the ledge slot 450 and the plate portion 404, as well as, the friction fit between the two coupled shafts 408 and 424.

In alternative arrangements, a two-piece connector may be adapted for window coverings have more than four lift cords. For instance, a two-piece connector with a generally square cross section could be used to secure five lift cords and a two-piece connector with a generally pentagonal cross section could be used to secure six lift cords. In various embodiments, a pull cord may not be utilized wherein the two-piece connector performs the function of a tassel. In other embodiments one or both of the shafts may be eliminated, wherein the internal member 402 merely comprises a notched plate member with or without a center hole. Additionally, embodiments are contemplated having a variety of assembled shapes. Furthermore, in other arrangements, the side members of the connector may not be identical to each other.

Although the present invention has been described with a certain degree of particularity, it is understood that the present disclosure has been made by way of example, and changes in detail or structure not specifically discussed herein may be made without departing from the spirit of the invention as defined in the appended claims.

I claim:

1. A connector for securing the ends of a plurality of lift cords of a window covering assembly in operative connection with a pull cord, the connector comprising:

a plurality of connecting means for separately securing each lift cord of the plurality of lift cords to said lift cord connector, said plurality of connecting means each comprising an enclosed channel, each enclosed channel being sized to completely confine and restrain the portion of a lift cord of the plurality of lift cords disposed therein; and a means for securing a pull cord to said lift cord connector.

2. A connector for securing the ends of a plurality of lift cords of a window covering assembly, the connector comprising:

a first section, the first section comprising a plurality of generally vertically orientated elongated channels; and a second section connectable with said first section to enclose at least a portion of each of the plurality of generally vertically orientated channels;

wherein each at least partially enclosed channel is sized to completely confine and restrain the vertical movement of the portion of a lift cord of the plurality of lift cords contained therein.

3. The connector of claim 2, wherein each channel of the plurality of channels further comprises a backside, at least a portion of the backside having an undulating surface.

4. The connector of claim 3, wherein the undulating surface comprises a series of angular ridges.

5. The connector of claim 2, wherein the first and second sections are joined together by a living hinge.

6. The connector of claim 2, further comprising a hole, the hole being sized to restrain a knotted end of a pull cord.

7. A clamshell connector for securing the ends of a plurality of lift cords of a window covering assembly, the connector comprising:

a first section, the first section having a first inside surface;

a second section, the second section having a second inside surface;

a hinge moveably joining the first and second sections;

one or more lift cord restraints including channels with undulating surfaces therein; and a connector for affixing said first inside surface against said second inside surface.

8. The connector of claim 7, wherein the hinge is a living hinge.

9. The connector of claim 7, wherein the hinge has a hole passing therethrough, the hole sized to restrain a knotted pull cord.

10. The connector of claim 7, wherein said channels are generally u-shaped and vertically disposed in the first inside surface, each channel having spaced sidewalls joined by a back wall.

11. A clamshell connector for securing the ends of a plurality of lift cords of a window covering assembly, the clamshell connector comprising:

a first section, the first section having a first top end, a first bottom end, a first left side, a first right side, and a first inside surface, the first inside surface having a substantially vertically orientated first plurality of channels disposed therein, each channel of the first plurality of channels having spaced sidewalls joined by a back wall and an open end, the open end coincident with the first top end;

a second section, the second section having a second top end, a second bottom end, a second left side, a second right side, and a second inside surface, the second inside surface having a substantially vertically orientated second plurality of channels disposed therein, each channel of the second plurality of channels having spaced sidewalls joined by a back wall and an open end, the open end coincident with the second top end; and one or more connector elements for affixing said first inside surface against said second inside surface;

wherein each channel of the first plurality of channels corresponds directly to a channel of the second plurality of channels to form an elongated receptacle for a lift cord that completely confines the portion of said lift cord within said receptacle when said first inside surface is affixed against said second inside surface.

12. A connector for securing the ends of a plurality of lift cords of a window covering assembly, the connector comprising:

a first section, the first section comprising a plurality of generally vertically oriented elongated channels; and a second section connectable with said first section to enclose at least a portion of each of the plurality of generally vertically oriented channels;

wherein each at least partially enclosed channel is sized to restrain the vertical movement of a lift cord of the plurality of lift cords contained therein and each channel further comprising a back side, at least a portion of the back side having an undulating surface.

13. The connector of claim 12 wherein the undulating surface comprises a series of angular ridges.

14. A clamshell connector for securing the ends of a plurality of lift cords of a window covering assembly, the connector comprising:

a first section, the first section having a first inside surface;

a second section, the second section having a second inside surface;

a hinge moveably joining the first and second sections;

one or more lift cord restraints comprising a first plurality of generally u-shaped channels substantially vertically disposed in the first inside surface, each channel of the first plurality of channels having spaced side walls joined by a back wall and wherein at least a portion of the back wall has an undulating surface.

15. The connector of claim 14 wherein the undulating surface comprises a first plurality of angular ridges spanning between the spaced side walls, each angular ridge of the first plurality of angular ridges having an apex.

16. The connector of claim 15, wherein the one or more lift cord restraints further comprise a second plurality of generally u-shaped channels substantially vertically disposed in the second inside surface, each channel of the second plurality of channels having spaced sidewalls joined by a back wall.

17. The connector of claim 16, wherein at least a portion of the back wall has a second undulating surface.

18. The connector of claim 17, wherein the second undulating surface comprises a second plurality of angular ridges spanning between the spaced sidewalls, each angular ridge of the second plurality of angular ridges having an apex.

19. The connector claim 18, wherein the apexes of the first plurality of angular ridges are directly opposed to the apexes of the second plurality of angular ridges when said first inside surface is affixed against said second inside surface.

20. The connector claim 15, further including a second plurality of generally u-shaped channels in said second inside surface and wherein each channel of the second plurality of generally u-shaped channels directly opposes a channel of the first plurality of generally u-shaped channels when said first inside surface is affixed against said second inside surface.

21. A clamshell connector for securing the ends of a plurality of lift cords of a window covering assembly, the connector comprising:

a first section, the first section having a first inside surface;

a second section, the second section having a second inside surface;

a hinge moveably joining the first and second sections;

one or more lift cord restraints; and a connector for fixing said first inside surface against said second inside surface, said connector including at least one substantially vertically oriented elongated protrusion on the first inside surface and at least one corresponding elongated depression on the second inside surface and further wherein said at least one elongated protrusion is received in said at least one elongated depression to frictionally join said first section to said second section.

22. A clamshell connector for securing the ends of a plurality of lift cords of a window covering assembly, the clamshell connector comprising:

a first section, the first section having a first top end, a first bottom end, a first left side, a first right side, and a first inside surface, the first inside surface having a substantially vertically oriented first plurality of channels disposed therein, each channel of the first plurality of channels having spaced sidewalls joined by a back wall and an open end, the open end coincident with the first top end;

a second section, the second section having a second top end, a second bottom end, a second left side, a second right side, and a second inside surface, the second inside surface having a substantially vertically oriented second plurality of channels disposed therein, each channel of the second plurality of channels having spaced side walls joined by a back wall and an open end, the open end coincident with the second top end; and one or more connector elements for affixing said first inside surface against said second inside surface;

wherein each channel of the first plurality of channels corresponds directly to a channel of the second plurality of channels to form an elongated receptacle for a lift cord when said first inside surface is affixed against said second inside surface; and wherein at least a portion of the back wall of each channel of the plurality of channels has a first undulating surface.

23. The connector of claim 22, wherein said second undulating surface is comprised of a second series of angular ridges extending between the spaced sidewalls of each channel, each angular ridge of the second series of angular ridges having an apex.

24. The connector of claim 23, wherein at least a portion of the back wall of each channel of the second plurality of channels has a second undulating surface.

25. The connector of claim 24, wherein said second undulating surface is comprised of a second series of angular ridges extending between the spaced sidewalls of each channel, each angular ridge of the second series of angular ridges having an apex.

26. The connector of claim 25, wherein the apex of each ridge of the first series of angular ridges is directly opposed by an apex of a ridge of the second series of angular ridges.

27. The connector of claim 26, wherein a distance between two opposing apexes is less than the diameter of a lift cord.

28. The connector of claim 22, further comprising a cavity formed by a depression in the first inside surface adjacent the first bottom end and an opposing depression in the second inside surface, said cavity being size to hold a knotted end of a pull cord, and having an opening passing through the first and second bottom ends and said living hinge, said opening sized to prevent a knotted end of a pull cord from passing therethrough.

29. The connector of claim 22, wherein the first plurality of channels comprises 4 channels.

30. The connector of claim 22, wherein the first and second sections are comprised of a polymeric based material.

* * * * *

UNITED STATES PATENT AND TRADEMARK OFFICE

CERTIFICATE OF CORRECTION

PATENT NO. : 6,640,870 B2
DATED : November 4, 2003
INVENTOR(S) : Anne J. Osinga

It is certified that error appears in the above-identified patent and that said Letters Patent is hereby corrected as shown below:

Column 14,
Line 9, after "the" insert -- first --;
Lines 11, 12 and 14, delete "second" and insert -- first --.

Signed and Sealed this

Thirteenth Day of April, 2004

JON W. DUDAS
*Acting Director of the United States Patent and Trademark Office*